US005356086A

United States Patent [19]

Takagi

[11] Patent Number: 5,356,086

[45] Date of Patent: Oct. 18, 1994

[54] FASCIMILE APPARATUS

[75] Inventor: Katsunori Takagi, Hyogo, Japan

[73] Assignee: Mitsubishi Denki Kabushiki Kaisha, Tokyo, Japan

[21] Appl. No.: 925,895

[22] Filed: Aug. 7, 1992

Related U.S. Application Data

[63] Continuation of Ser. No. 437,197, Nov. 16, 1989, abandoned.

[30] Foreign Application Priority Data

Dec. 14, 1988 [JP] Japan ..... 63-313726

[51] Int. Cl.[5] ..... B65H 75/02

[52] U.S. Cl. ..... 242/596.7

[58] Field of Search ..... 242/55, 55.2, 55.53, 242/68, 68.4

[56] References Cited

U.S. PATENT DOCUMENTS

| | | | |
|---|---|---|---|
| 2,171,648 | 9/1939 | Ennis et al. | 242/55.2 |
| 2,622,814 | 12/1952 | Benke | 242/55.2 |
| 2,632,605 | 3/1953 | Lee | 242/55.2 |
| 3,878,998 | 4/1975 | Lazzari | 242/55.2 |
| 4,372,500 | 2/1983 | Saraisky | 242/55 |
| 4,458,851 | 7/1984 | Tokuno | 242/55 |
| 4,532,529 | 7/1985 | Fushimoto | 242/55.2 X |
| 4,632,585 | 12/1986 | Oyamatsu | 242/55.2 X |

FOREIGN PATENT DOCUMENTS

| | | | |
|---|---|---|---|
| 6908826 | 3/1969 | Fed. Rep. of Germany . | |
| 3509218 | 9/1985 | Fed. Rep. of Germany . | |
| 186857 | 10/1984 | Japan | 242/55.2 |
| 0052444 | 3/1985 | Japan | 242/55.2 |
| 0052445 | 3/1985 | Japan | 242/55.2 |
| 0017753 | 1/1988 | Japan | 242/55.2 |
| 1604409 | 12/1981 | United Kingdom . | |

*Primary Examiner*—Stuart S. Levy
*Assistant Examiner*—Paul J. Ditmyer
*Attorney, Agent, or Firm*—Rothwell, Figg, Ernst & Kurz

[57] ABSTRACT

A facsimile apparatus of the type in which recording paper is successively fed toward a recording position from a roll wound on a spool, the machine being provided with a pair of flange members detachably attached to the opposite ends of the spool and each having an outwardly extending cylindrical shaft portion, and engaging means formed on a roll holder box for engaging and rotatably supporting the cylindrical shaft portions of the respective flange members. The flange members restrict undesirable movements of recording paper in the paper feed and discharge directions as well as in lateral directions, thereby precluding damages of recording paper which would result from oblique motions of the paper and ensuring stable and secure travel of recording paper.

1 Claim, 2 Drawing Sheets

FIG. 1 (PRIOR ART)
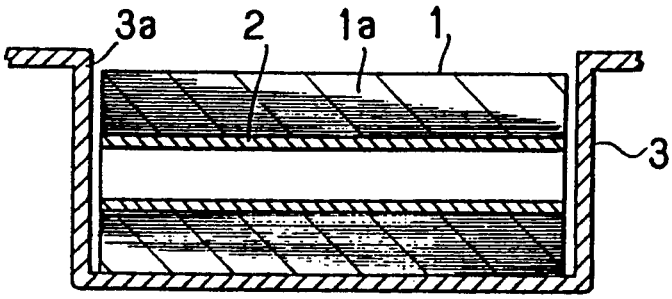
FIG. 2 (PRIOR ART)
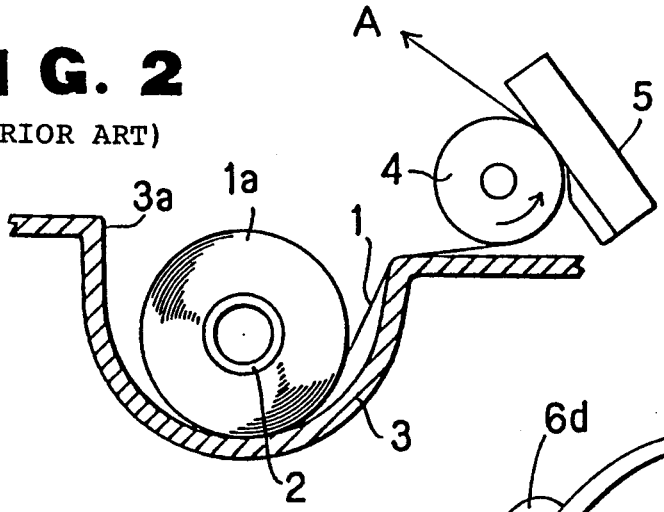
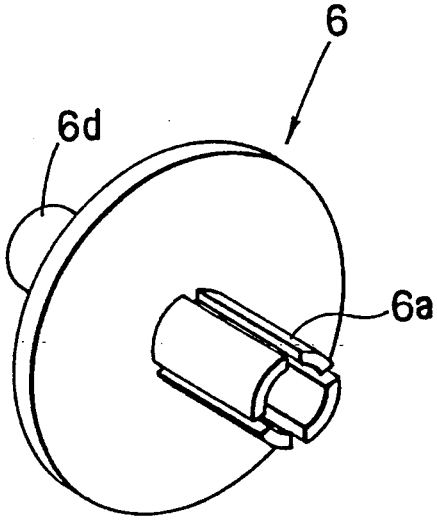
FIG. 7
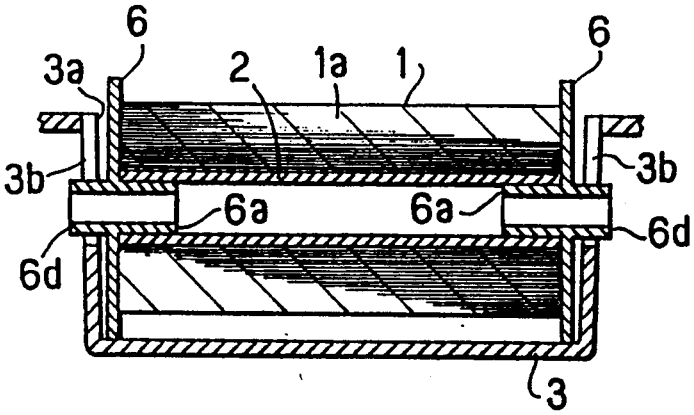
FIG. 3

FASCIMILE APPARATUS

This is a continuation of application Ser. No. 07/437,197, filed Nov. 16, 1989, now abandoned.

BACKGROUND OF THE INVENTION

1. Field of the Invention

This invention relates to a facsimile apparatus of the type which uses a roll of recording paper wound on a spool.

2. Description of the Prior Art

FIGS. 1 and 2 illustrate in sectioned front and side views a conventional facsimile apparatus as disclosed in Japanese Laid-Open Utility Model Application 60-25268, in which 1 is a thermo-sensitive recording paper wound on a tubular spool 2 and forming a roll portion 1*a* around the spool 2. 3 is a roll holder tray having a recess 3*a* of substantially semicircular cross-sectional shape for nesting the roll portion therein. The recording paper 1 is drawn out from the lower side of the spool 2 and around a platen roller 4. 5 is a thermal head which prints images by contacting the recording paper 1 as it passes around the platen roller 4.

Next, operation will be described. Normally the recording paper 1 is set in position simply by placing the roll portion 1*a* on the spool 2 in the recess 3*a* of the roll holder tray 3. The recording paper is rolled around the spool such that its printing face is disposed on the outer side, and the recording paper is drawn out from the lower side of the pool 2 and passed around the platen roller 4 for pressure contact with the thermal head 5. The paper which has undergone thermal recording by the thermal head 5 is discharged in the direction of arrow A.

Conventional facsimile apparatus arranged in the above-described manner have a problem that, when the diameter of the roll portion 1*a* of the recording paper 1 on the spool 2 become small as the paper is consumed, it is likely that the roll is tilted by a pulling force acting on the lower side of the roll portion 1*a*, as a result destabilizing the transport of the recording paper or causing the paper to advance obliquely and enter the path between the platen roller 4 and the thermal head 5 at an oblique angle. If recording is effected on the paper in such a state, the roll portion 1*a* tends to engage the side wall surfaces of the recess 3*a*, such that withdrawal of the paper under such conditions causes damage to the recording paper.

Further, when the recording paper is replaced by a roll of a different width, especially when replaced by a roll of a smaller width, the oblique motion of the paper is more likely to occur, necessitating the provision of guide members respectively for paper rolls of different widths.

SUMMARY OF THE INVENTION

It is an object of the present invention to provide a facsimile apparatus which can feed recording paper from a roll stably and without oblique motions irrespective of the rolled paper diameter to prevent paper damage which would result from unstable paper motion.

It is another object of the present invention to provide a facsimile apparatus which can feed recording paper from a roll securely without oblique motion irrespective of the width of the rolled paper.

It is still another object of the invention to provide a facsimile apparatus which can feed recording paper in a secure and stable manner by simple and inexpensive means, without resorting to any expensive device.

According to an aspect of the invention, for achieving the above-mentioned objects, there is provided a facsimile apparatus which includes: a spool for supporting thereon a roll of recording paper; a flange member attached to each end of the spool and having a cylindrical shaft portion on the outer side thereof; and a rolled recording paper holder box having engaged means adapted to engage with and rotatable support the cylindrical shaft portions at the opposite ends of the spool in such a manner as to prevent undesirable irregular motion of the rolled recording paper.

According to another aspect of the invention, the flange member is provided with a short shaft portion and a long shaft portion formed in back-to-back relation on the opposite sides thereof and detachably attachable to the spool; and a stopper projection provided retractably on the long shaft portion of each flange member in a position equalizing the width of a roll of narrow recording paper with that of the roll holder box thereby to restrict undesirable motion of rolled recording paper.

The facsimile apparatus of the invention is capable of transporting the recording paper continuously in a stable state free of oblique motion even when the rolled paper portion on the spool is reduced to a small diameter.

Further, the facsimile apparatus of the invention is capable of feeding the recording paper continuously in a secure posture free of undesirable deviational or oblique motion even when the paper roll has a small width.

The above and further objects and novel features of the invention will more fully appear from the following detailed description given in connection with the accompanying drawings. It is to be expressly understood, however, that the drawings are for purposes of illustration only and are not intended to limit the invention.

BRIEF DESCRIPTION OF THE DRAWINGS

FIG. 1 is a sectional front view of a conventional facsimile apparatus;

FIG. 2 is a sectional side view of the conventional facsimile apparatus of FIG. 1;

FIG. 3 is a sectional front view of a facsimile apparatus according to one embodiment of the present invention;

FIG. 7 is a perspective view of the flange 6 shown in FIG. 3.

DETAILED DESCRIPTION OF THE PREFERRED EMBODIMENTS

The preferred embodiments of the invention will be described in detail with reference to the accompanying drawings.

Figure 4:
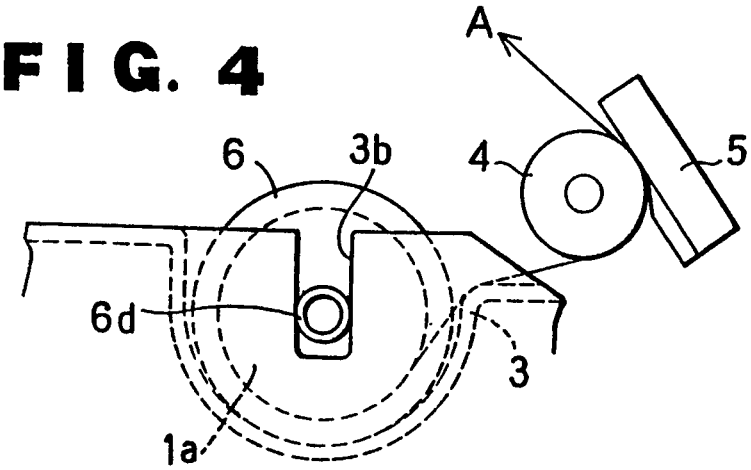
FIG. 4 is a fragmentary side view of the apparatus of FIG. 3.

FIGS. 3 and 4 show a facsimile apparatus embodying the present invention in a sectional front view and a fragmentary side view, respectively, in which the component parts common to those in FIGS. 1 and 2 are designated by common reference numerals, their description being omitted to avoid unnecessary repetition.

Indicated at 6 are flanges which are press-fitted into the opposite ends of a tubular spool 2, which have an outer diameter slightly larger than the maximum diameter of a roll portion 1*a*, and which engage and hold the opposite ends of the roll portion 1*a* on the spool 2.

Each flange 6 is integrally provided with a cylindrical shaft-like portion 6*a* adapted to be press-fitted into the spool 2 as shown in FIG. 3.

This fit-in shaft portion 6*a* has an outer diameter slightly larger than the inner diameter of the bore of spool 2, and is press-fitted into the bore of spool 2 in cooperation with four axial slits as shown in FIG. 7 which are formed axially from the outer end of the shaft portion 6*a* to impart thereto resiliency in the radial direction. Further, the flange 6 is centrally provided with an axially outwardly extending shaft portion 6*d* opposite to the shaft portion 6*a*.

U-shaped guide grooves 3*b* are formed in the opposite side walls of roll holder tray 3 to engage shaft portions 6*d*.

The disk-shaped portion of the flange 6 preferably has an outer radius which is slightly larger than the distance between the inner bottom surface of the roll holder tray 3 and the bottom surface of the guide groove 3*b*, and is thus in abutting engagement with the inner bottom surface of-the roll holder tray 3 at the outer peripheral edge of the flange 6. As shown most clearly in FIG. 4, there is a clearance between the bottom surface of the guide groove and the shaft portion 6*d*.

Next, the operation will be described. The recording paper 1 is drawn out from the lower side of the roll portion 1*a*, so that the diameter of the roll portion 1*a* is gradually reduced and finally becomes almost as small as the outer diameter of the spool. At such point, the gap space between the roll portion 1*a* and the inner surface of the recess 3*a* becomes far larger than a gap space formed by a roll of a large diameter. However, since the flanges 6 holding the opposite ends of the roll portion 1*a* maintain a constant gap between the flanges 6 and the inner surfaces of the recess 3*a* irrespective of the roll diameter, the flanges 6 and roll 1*a* are retained in substantially the same regular motion in the recess 3*a* without being influenced by the roll diameter. Therefore, the recording paper 1 is fed out stably and prevented from advancing obliquely between the platen roller 4 and the thermal head 5.

Further, irregular motions of the recording paper 1 are eliminated as the shaft portions 6*d* of the I- 25 flanges 6 are held in the guide grooves 3*b*. In addition, the abutting engagement of the outer peripheral edges of the disk-like portions of the flanges 6 with the inner bottom surfaces of the roll holder tray 3 generates frictional forces, which contribute to stable travel of the recording paper by applying a certain tension thereto to prevent slackening of the recording paper 1 which would otherwise be caused by over-rotation of the roll portion 1*a*. The shaft portions 6*d* have a length sufficient to accommodate different widths of recording paper.

Figure 5:
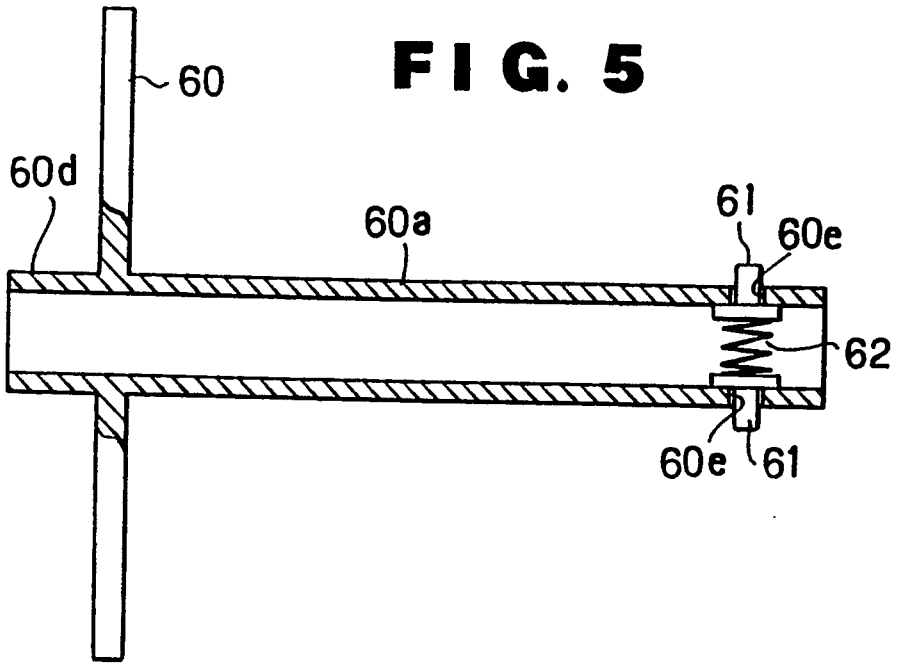
FIG. 5 is a partly sectional front view of a flange member of another embodiment of the invention.
Figure 6:
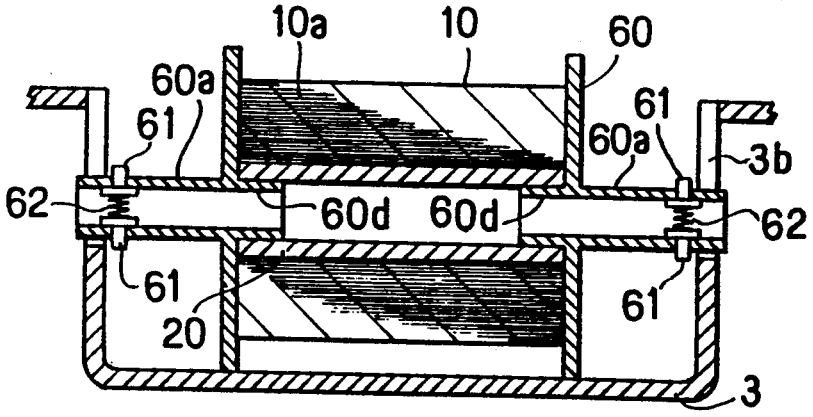
FIG. 6 is a sectional front view of a facsimile apparatus according to another embodiment of the invention.

FIGS. 5 and 6 show another embodiment of the invention by way of a sectional side view of the flange and a sectional front view of the facsimile apparatus, respectively. In these figures, the component parts common to FIGS. 3 and 4 are designated by common reference numerals and their descriptions are omitted to avoid repetition.

In these figures, indicated at 10 is a recording thermosensitive paper of a small width, 20 is a tubular spool carrying a roll of the recording paper 10, 10*a* is a roll portion of the recording paper 10, and 60 are flanges fitted in the opposite end portions of the tubular spool 20. Each flange 60 is integrally provided with an axially extending cylindrical short shaft portion 60*d* and a long shaft portion 60*a* centrally on the opposite sides of its disk-like body. The long shaft portion 60*a* is provided with fitting holes 60*e* (seen move clearly in FIG. 5) in a position to secure the roll of narrow width recording paper within the roll holder tray 3. Stopper projections 61 are retractably fitted in the apertures 60*e* by the use of resilient urging means such as springs 62. The short shaft portion 60*d* has another diameter which is slightly larger than the inner diameter of the spool 20, and press-fitted in the spool 20 in cooperation with four axial slits as shown in FIG. 7 which are formed axially from the outer end of the short shaft portion 60*d* to impart thereto resiliency in the radial direction. Although the longer shaft portion 60*a* has an outer diameter slightly smaller than the spool 2 carrying a paper roll of large width, it can be fitted into the spool 2 with similar press-fit effect by the pressing forces of the retractable stopper projections 61 against the inner periphery of the spool 2.

Next, operation will be described. When using a roll of recording paper 10 with a smaller width, the short shaft portions 60*d* of the flanges 60 are press-fitted into the opposite ends of the spool 20. Thus, the flanges 60 become rotatable integrally with the roll of recording paper 10. The long shaft portions 60*a* which extend outwardly from the respective flanges 60 at the opposite ends are then engaged in the U-shaped guide grooves 3*a* of the holder box 3. In this position, the retractable projections 61 on the long shaft portions 60*a* act as stoppers for restricting undesirable lateral movements of the recording paper 10. Therefore, the recording paper 10 is invariably fed in centralized state. On the other hand, when using a roll of recording paper having a larger width, the long shaft portions 60*a* are press-fitted into the spool 20 with retractable projections 61 providing a holding force for the spool.

As described hereinbefore, according to the present invention, the spool which carries a roll of recording paper is provided with flanges at the opposite ends thereof, the flanges each having an outwardly extending shaft portion which is engageable with a guide groove of a recording paper holder box to restrict undesirable movements of the rolled recording paper.

This arrangement is effective for feeding the recording paper constantly in a stable state without being influenced by the diameter of the rolled recording paper and free of damage.

Furthermore, according to another aspect of the invention, the flanges are provided with a short shaft portion and a long shaft portion centrally on the opposite side thereof, and retractable stopper projections fitted in the long shaft portion in a position to maintain narrow width recording paper roll stably within the roll holder box, thereby restricting unnecessary or undesirable movements in the lateral direction of the recording paper to realize stable and secure travel of the recording paper irrespective of its width.

What is claimed is:

1. A facsimile apparatus, comprising:

a recording paper roll holder box for holding a roll of recording paper of various widths on which images are recorded by a recording head;

first and second flange members each having a permanently fixed, unremovable axially extending short portion and a permanently fixed, unremovable axially extending long portion on opposing sides thereof, and axially extending long portions having radially retractable projections thereon, said short portions being detachably engageable in respective ends of a roll of relatively small width and said long portions being detachably engageable in respective ends of a roll of relatively large width, by reversing the orientation of said flange members with respect to said rolls;

said roll holder box including engaging means for engaging said axially extending short portions when a roll of relatively large width recording paper is used in said apparatus, and for engaging and rotatably supporting said axially extending long portions when a roll of relatively small width recording paper is used in said apparatus, wherein said radially retractable projections project from said axially extending long portions when said roll of relatively small width is used, to prevent said roll of relatively small width from moving on an axial direction within said roll holder box by contacting inner surfaces of said roll holder box adjacent said engaging means, and wherein said radially retractable projections are retracted into said axially extending long portions when said roll of relatively large width is used in said apparatus.

* * * * *

UNITED STATES PATENT AND TRADEMARK OFFICE

CERTIFICATE OF CORRECTION

PATENT NO. : 5,356,086

DATED : October 18, 1994

INVENTOR(S) : Katsunori Takagi

It is certified that error appears in the above-indentified patent and that said Letters Patent is hereby corrected as shown below:

Col. 3, line 50, delete "I - 25".

Col. 6, line 10, "on" should be --in--.

Signed and Sealed this

Twenty-eight Day of February, 1995

*Attest:*

*Attesting Officer*

BRUCE LEHMAN

*Commissioner of Patents and Trademarks*